US007685927B1

(12) United States Patent
Hanser et al.

(10) Patent No.: US 7,685,927 B1
(45) Date of Patent: Mar. 30, 2010

(54) HYDRAULIC SYNCHRONIZING CYLINDER

(75) Inventors: Paul Edmund Hanser, Tipton, IA (US); Marc Frerichs, Eldridge, IA (US)

(73) Assignee: HWH Corporation, Moscow, IA (US)

( * ) Notice: Subject to any disclaimer, the term of this patent is extended or adjusted under 35 U.S.C. 154(b) by 438 days.

(21) Appl. No.: 11/680,345

(22) Filed: Feb. 28, 2007

(51) Int. Cl.
*F15B 11/22* (2006.01)
*F01B 7/16* (2006.01)

(52) U.S. Cl. ..... 91/515; 60/546

(58) Field of Classification Search ..... 60/546; 91/515; 92/152
See application file for complete search history.

(56) References Cited

U.S. PATENT DOCUMENTS 3,579,989 A * 5/1971 Stark et al. ..... 60/546
4,337,687 A 7/1982 Hoover
4,409,884 A 10/1983 Boehringer
6,408,736 B1 6/2002 Holt et al.
2002/0170785 A1* 11/2002 Stockmann ..... 187/275
2004/0020197 A1* 2/2004 Cray ..... 60/485

* cited by examiner

*Primary Examiner*—Michael Leslie
(74) *Attorney, Agent, or Firm*—Jason R. Sytsma; Shuttleworth & Ingersoll, PLC

(57) ABSTRACT

A synchronizing cylinder comprising a large diameter barrel and a small diameter barrel. The barrels are separated by a junction that is not fluidly sealed so that fluid can be communicated between them. The volume of the large diameter barrel is twice the volume of the small diameter barrel. The barrels comprise a first chamber adapted to communicate fluid to and from a hydraulic manifold, a second chamber adapted to communicate fluid to and from a first mechanism cylinder, and a third chamber adapted to communicate fluid to and from a second mechanism cylinder. The volumetric ratio of the barrels allows an equal volume of fluid to be communicated to and from the mechanism cylinders even though the volume of the barrels is not the same.

9 Claims, 11 Drawing Sheets

HYDRAULIC SYNCHRONIZING CYLINDER

BACKGROUND OF THE INVENTION

It has become desirable in various industries to have hydraulic cylinders that move in synchronization with each other, whether it is a retracting motion or an extending motion or both. One device used to synchronize the movement of multiple hydraulic mechanism cylinders is called a series cylinder or synchronizing cylinder. Synchronizing cylinders are generally described in U.S. Pat. Nos. 4,409,884 (Boehringer) and 6,408,736 (Holt et. al.), which are hereby incorporated by reference. Generally, a synchronizing cylinder is a cylinder in a hydraulic circuit that aids in delivering a predetermined volume of fluid to several mechanism cylinders at the same time. (The mechanism cylinders are the cylinders that combine with the mechanism that is being moved by the hydraulic power.) The synchronizing cylinder is actually several cylinders tied together in one unit. There is one chamber in the synchronizing cylinder for each mechanism cylinder. There is a piston in each synchronizing cylinder chamber to move the fluid. The pistons are tied together by a rod so that when one piston moves, the other piston(s) moves the same distance at the same speed.

Traditional synchronizing cylinders generally perform well, however, they comprise elements that make them complex and expensive to manufacture. FIG. 9 shows a sectional view of a traditional synchronizing cylinder 110 comprising some of the elements that make traditional synchronizing cylinders 110 complex and expensive. FIG. 9 shows a synchronizing cylinder 110 having a hollow rod 80, a seal 84, and an external rod portion 82. Traditional synchronizing cylinders 110 require the hollow rod 80 to connect the cap sides of the chambers for synchronizing purposes. The seal 84 is a fluid barrier between the cap side of one chamber and the rod side of the adjacent chamber. The seal 84 has been required in traditional synchronizing cylinders 110 to direct the proper volume of fluid to and from the respective chambers of the synchronizing cylinder 110. The external rod portion 82 is a portion of the rod 120 that extends out from the cylinder 110 as the cylinder 110 is retracted. The external rod portion 82 has been required in traditional synchronizing cylinders 110 to ensure that the volume of each chamber was equal. Without the external rod portion 82 moving into the synchronizing cylinder 110 as the cylinder 110 is extended, the end chamber would have a volume greater than the other chambers in the synchronizing cylinder 110.

SUMMARY OF THE INVENTION

The invention comprises a synchronizing cylinder that allows for the synchronized movement of multiple hydraulic mechanism cylinders. In one embodiment, the synchronizing cylinder comprises a large diameter barrel and a small diameter barrel. The large diameter barrel further comprises a large piston therein and the small diameter barrel further comprises a small piston therein. The pistons are combined together with a rod so that the movement of one piston causes the other pistons to move the same distance at the same speed. The barrels are separated by a junction through which the rod passes and that is not fluidly sealed so that fluid can be communicated between the barrels. The barrels comprise a first chamber on one side of the piston in the large barrel adapted to communicate fluid to and from a hydraulic manifold, a second chamber between the other side of the piston in the large barrel and the piston in the small barrel adapted to communicate fluid to and from a first mechanism cylinder, and a third chamber in the small barrel adapted to communicate fluid to and from a second mechanism cylinder.

The volume of fluid being communicated between the various components of any synchronizing cylinder is of utmost importance. If the mechanism cylinders are adapted to receive equal volumes and travel the same distances, then the fluid communicated to and from the mechanism cylinders by the synchronizing cylinder must also be equal. The present invention provides a unique and simple synchronizing cylinder configuration that allows equal volumes of fluid to be communicated to and from the mechanism cylinders even though the volume of the synchronizing cylinder barrels/chambers is not equal.

The sealed volume of the large diameter barrel is twice the sealed volume of the small diameter barrel. A short hand approach to describe this concept is that V equals the volume in small diameter barrel and 2V equals the volume in the large diameter barrel. The sealed volume means the total volume of the barrels, not just the fluid volume, i.e. the sealed volume may include the volume of the rod. During operation, the barrels remain stationary; however, the chambers inside the barrels move as the rod/piston assembly moves since the pistons comprise at least one wall of each of the chambers. In the synchronizing cylinder's retracted position, the third chamber is defined by the small diameter barrel having a volume equal to V. The second chamber is defined by the area between the pistons minus the area of the junction. Therefore, in the synchronizing cylinder's retracted position, the second chamber is defined by the large diameter barrel having a volume 2V. However, in the synchronizing cylinder's extended position, the second chamber is defined by the small diameter barrel having a volume of V.

The volumetric ratio between the large diameter barrel and the small diameter barrel allows the second chamber and third chamber to communicate the same volume of fluid (V) to their respective mechanism cylinders even through the volume of the second chamber is twice the volume of the third chamber when the synchronizing cylinder is retracted. As the synchronizing cylinder is moved from its retracted position to its extended position, the third chamber communicates all of its fluid (equaling volume V) to its respective mechanism cylinder. As discussed above, the second chamber has a volume 2V in the synchronizing cylinder's retracted position. During extension, the second chamber communicates an amount of fluid equaling volume V to its respective mechanism cylinder. The other volume V from the second chamber remains in the second chamber, i.e. between the pistons. As the synchronizing cylinder extends, this other volume V is communicated from the large diameter barrel into the small diameter barrel through the junction.

The volumetric ratios of the synchronizing cylinder of the present invention provide a design that is greatly simplified compared with existing synchronizing cylinder designs. The use of multiple barrels having different volumes eliminates the need for the hollow rod that prior synchronizing cylinders have needed to fluidly connect the chambers. Further, the invention eliminates the need of having a portion of the rod extend outside of the synchronizing cylinder.

BRIEF DESCRIPTION OF THE DRAWING

FIG. 5*a* is a sectional view similar to FIG. 5 wherein the area of the shaded potion in the large diameter barrel represented by the wavy lines is the same as the area of the shaded portion of smaller diameter barrel represented by the circles;

DETAILED DESCRIPTION OF THE INVENTION

The invention comprises a synchronizing cylinder 10 that allows for the synchronized movement of multiple hydraulic mechanism cylinders 12, 14 in a manner that is greatly simplified compared to existing synchronizing cylinders 10. It should be noted that although the invention is described herein as being used with hydraulic fluid, one skilled in the art will recognize that any other suitable fluid may be used. Further, it should be noted that the invention can be used with two or more mechanism cylinders 12, 14 by simply adding chambers having appropriate volume ratios (described below) to the synchronizing cylinder 10.

Figure 1:
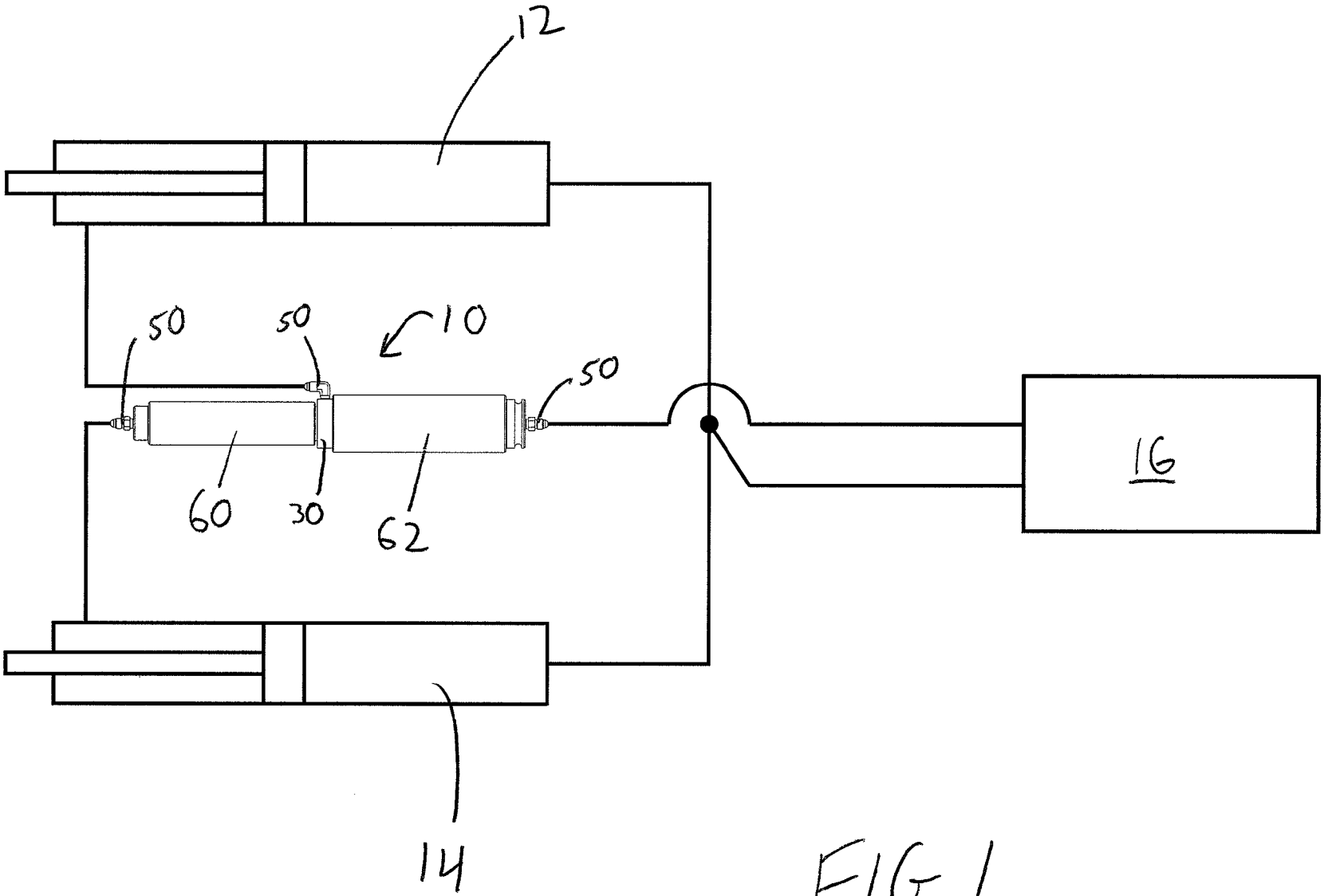
FIG. 1 is a schematic view of an embodiment of the synchronizing cylinder in communication with two mechanism cylinders.
Figure 2:
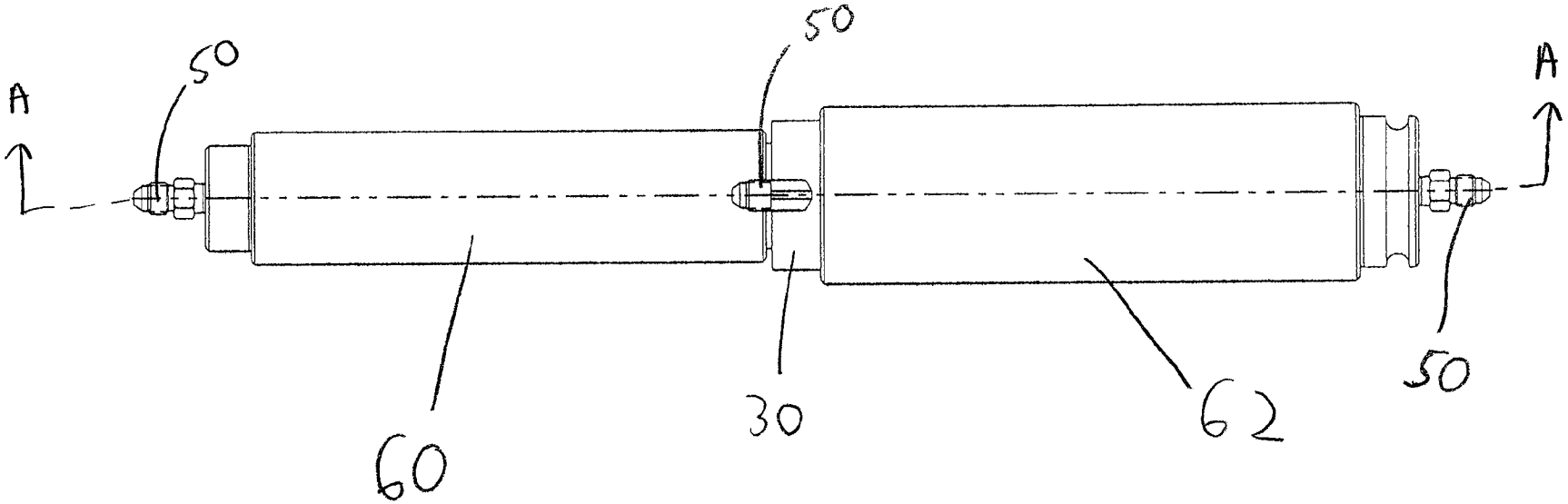
FIG. 2 is a side view of an embodiment of the synchronizing cylinder of the present invention.

FIG. 1 shows a hydraulic circuit comprising a synchronizing cylinder 10, two mechanism cylinders 12, 14, and a manifold 16. FIG. 1 shows a regenerative hydraulic circuit, however, any other suitable circuit may be used. FIGS. 2-6 show embodiments of the synchronizing cylinder 10 wherein the synchronizing cylinder 10 comprises a large diameter barrel 62 and a small diameter barrel 60. The large diameter barrel 62 further comprises a large piston 24 therein and the small diameter barrel 60 further comprises a small piston 22 therein. The pistons 22, 24 are combined with a rod 20 so that the movement of one piston 22 causes the other piston 24 to move the same distance at the same speed. Each end of the synchronizing cylinder 10 has an end cap 32 and 34. The end cap 32 includes the port 50 to distribute fluid to and from one of the mechanism cylinders 14 and the end cap 34 includes the port 50 to distribute fluid to and from the pump manifold 16. The barrels 60, 62 are separated by a junction 30 that is not fluidly sealed so that fluid can be communicated between them 60, 62. The junction 30 includes a port 50 to communicate fluid to and from one of the mechanism cylinders 12. The barrels 60, 62 define a first chamber 40 adapted to communicate fluid to and from a hydraulic manifold 16, a second chamber 42 adapted to communicate fluid to and from a first mechanism cylinder 12, and a third chamber 44 adapted to communicate fluid to and from a second mechanism cylinder 14.

Figure 3:
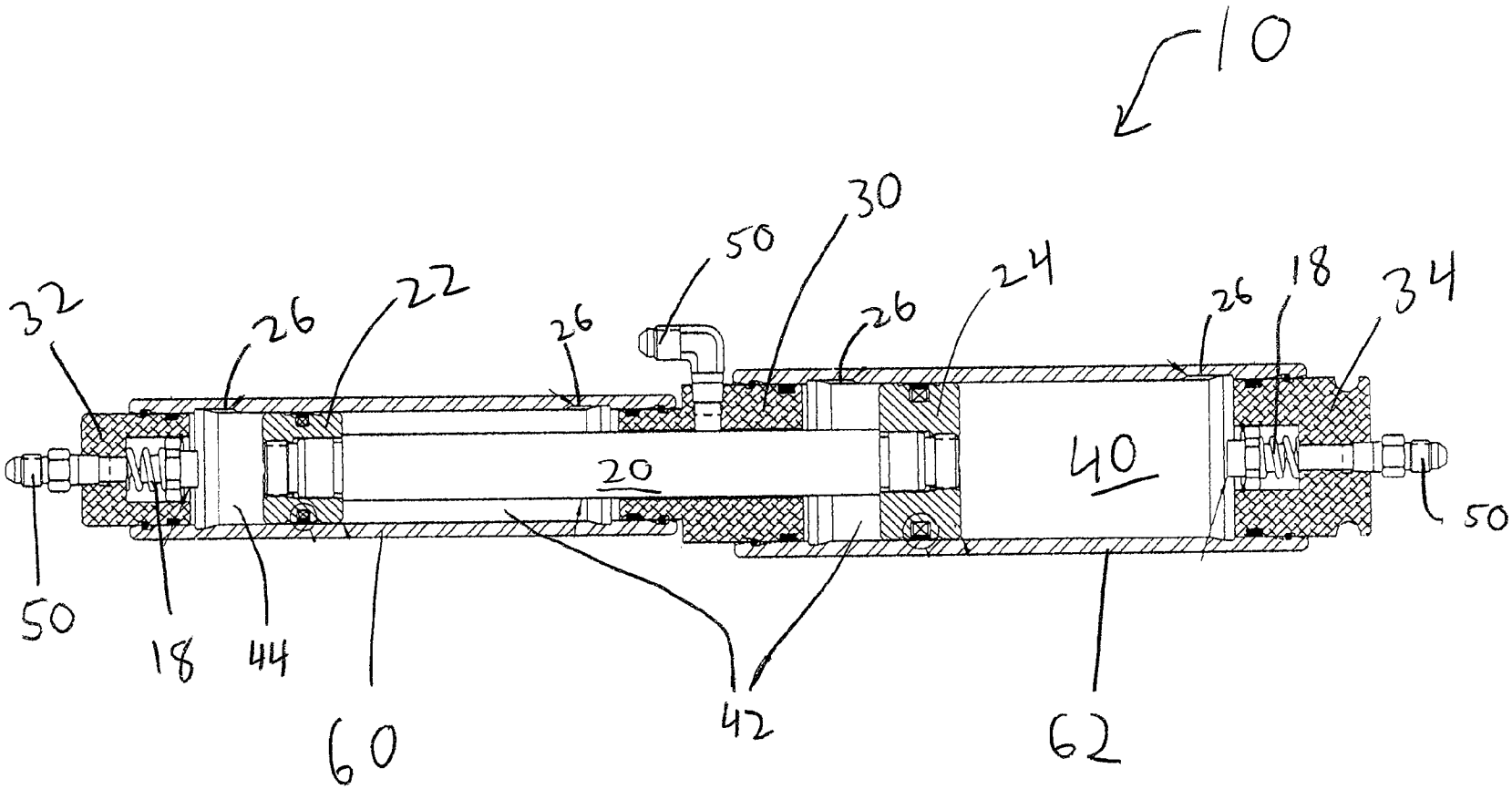
FIG. 3 is a sectional view taken on the line A-A of FIG. 2 and showing the device as it is being extended.
Figure 4:
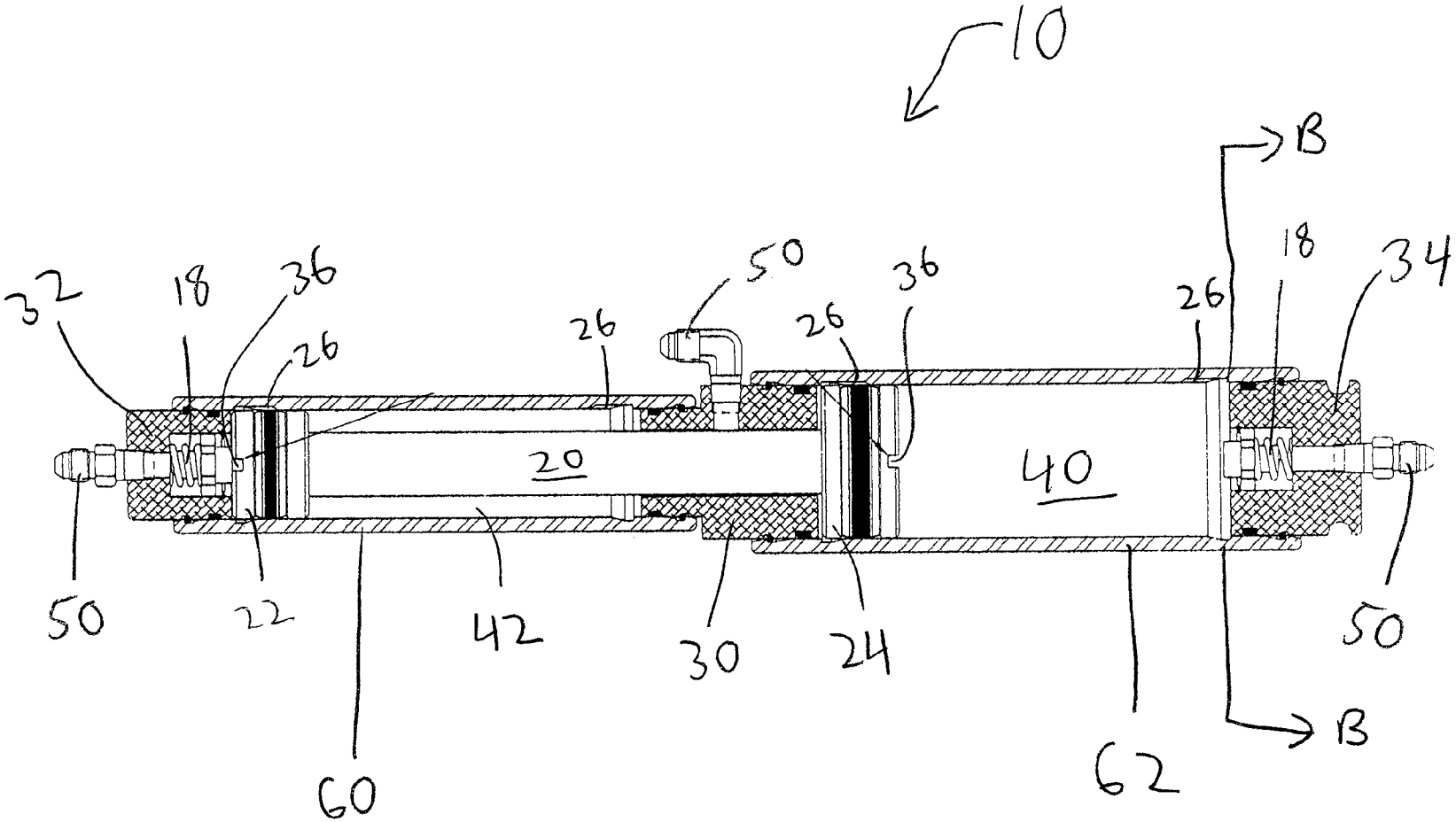
FIG. 4 is a sectional view similar to FIG. 3 but showing the device in its fully extended position.
Figure 5:
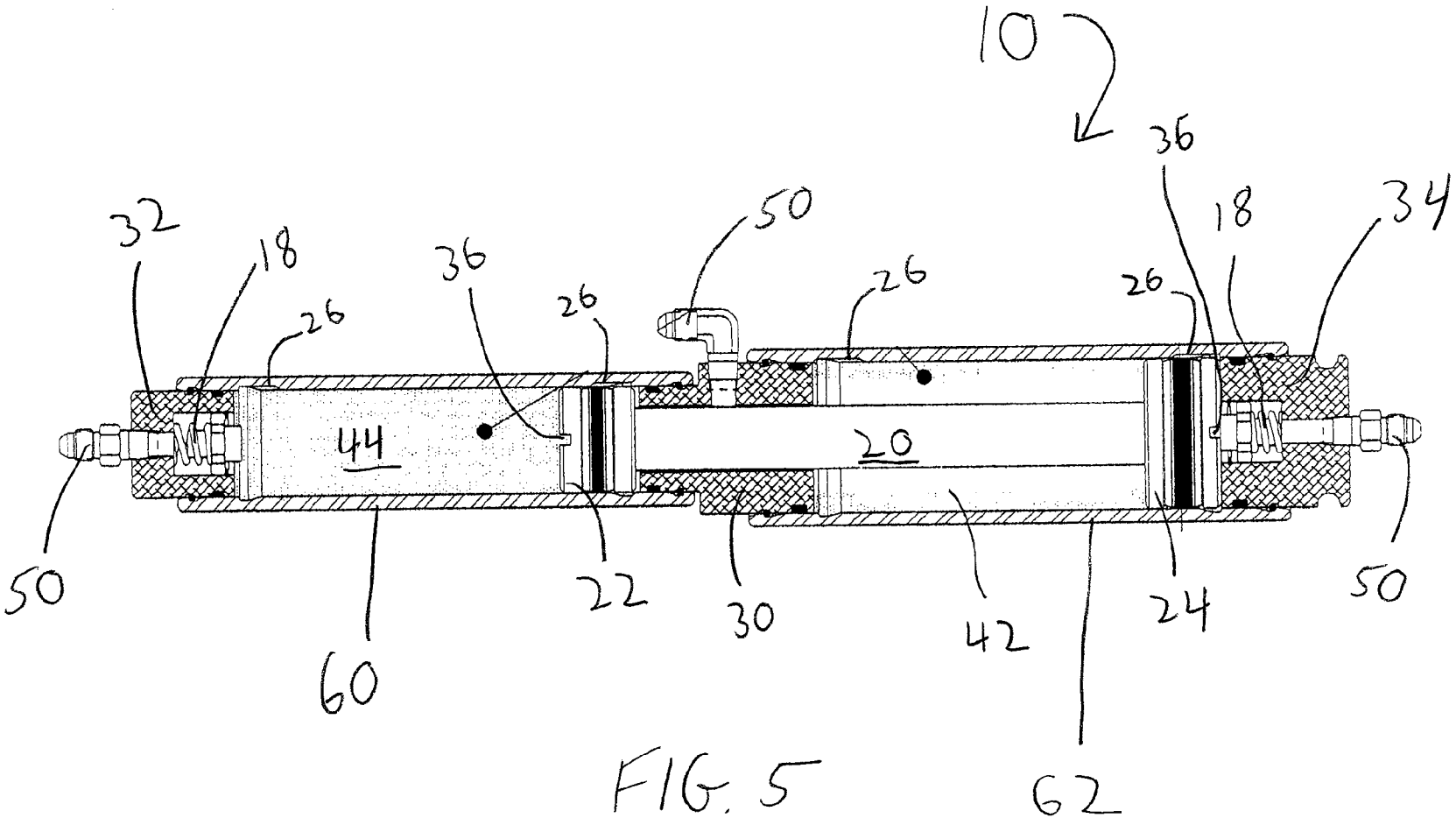
FIG. 5 is a sectional view similar to FIG. 4*a* but showing the device in its retracted position.
Figure 5:
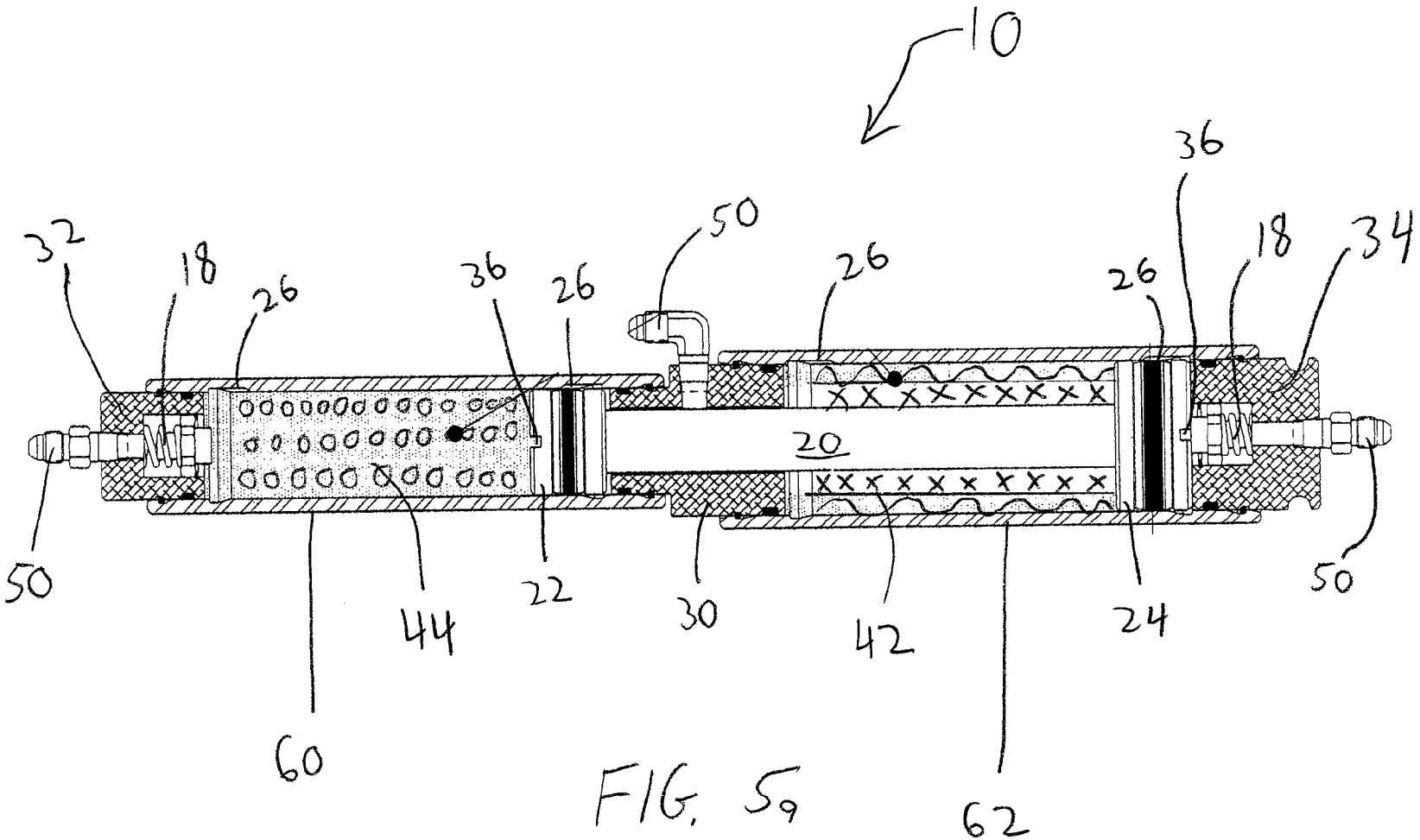

The first chamber 40 is defined as the area between the end cap 34 and the large piston 24. The second chamber 42 is defined as the area between the large piston 24 and the small piston 22 not including the area of the junction 30. The third chamber 44 is defined as the area between the small piston 22 and the end cap 32. During operation of the cylinder 10, the barrels 60, 62 remain stationary; however, the fluid in the chambers 40, 42, 44 inside each of the barrels 60, 62 moves as the rod 20/piston 22, 24 assembly moves since the pistons 22, 24 comprise at least one wall of the chambers 40, 42, 44. FIGS. 3-5 show the changing of the size and thus the amount of fluid in the chambers 40, 42, 44 as the rod 20/piston 22, 24 assembly is moved to different positions. What happens as this assembly moves from a fully retracted to a fully extended position will now be described.

FIGS. 5 and 5*a* show the synchronizing cylinder 10 in the fully retracted position and demonstrate the fluid volumes of the second chamber 42 and third chamber 44 by shading. In the synchronizing cylinder's retracted position, the fluid capacity or volume $V_o$ of the third chamber 44 is represented by the circle shading. The fluid capacity of the second chamber 42 can be broken down into two components. The first component $V_\sim$ is the volume of fluid represented by the wavy line shading in the second chamber 42, which is the volume of fluid that is communicated to and from the mechanism cylinder 12, and $V_\sim$ is equal to $V_o$. The second volume component $V_x$ comprises the fluid volume represented by the X shading (FIG. 5*a*). The volume $V_R$ is the volume occupied by the rod 20 that is in the second chamber 42. In the fully retracted position, $V_o=V_\sim$, and the total volume $V_T$ of the large barrel 62 is the sum of $V_\sim$, $V_X$ and $V_R$ ($V_T=V_\sim+V_X+V_R$). Also, $V_o=V_x+V_R$.

Figure 4A:
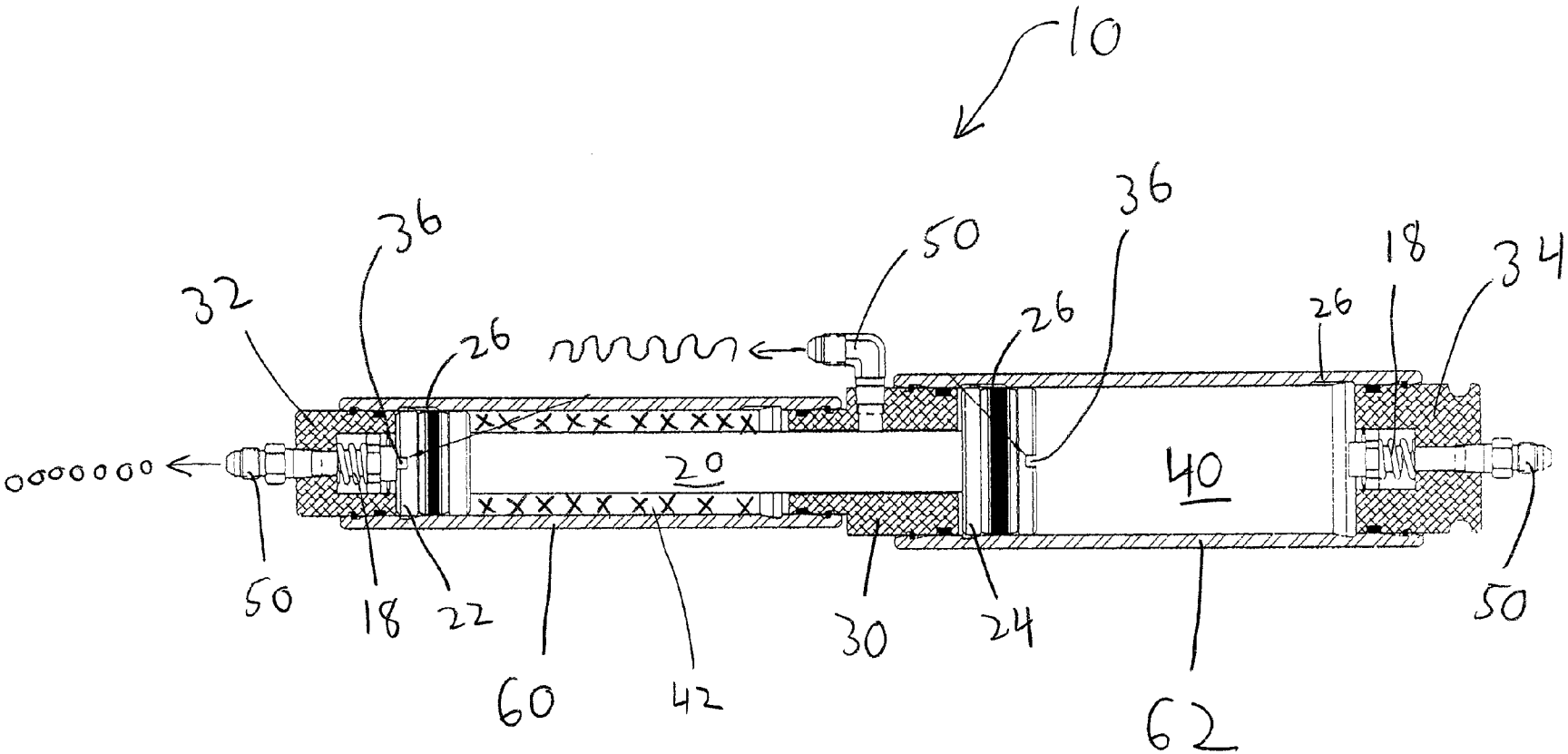
FIG. 4*a* is a sectional view similar to FIG. 4 wherein shading represented by Xs shows the fluid from the large diameter barrel that has been passed through the junction to the small diameter barrel.

Thus, the volumetric ratio between the large diameter barrel 62 and the small diameter barrel 60 allows the second chamber 42 and third chamber 44 to communicate the same volume of fluid to their respective mechanism cylinders 12, 14 even through the fluid volume of the second chamber 42 ($V_x+V_\sim$) is greater than the volume $V_o$ of the third chamber 44 when the synchronizing cylinder 10 is fully retracted. FIG. 5*a* can be compared with FIG. 4*a* to show what happens to the fluid in the chambers 40, 42, 44 as the synchronizing cylinder 10 changes from its fully retracted position (FIG. 5*a*) to its fully extended position (FIG. 4*a*). As the synchronizing cylinder 10 is extended, the volume of fluid $V_o$ in the third chamber 44 is communicated to its respective mechanism cylinder 14. Simultaneously, the volume of fluid $V_\sim$ in the second chamber 42 is communicated in an equal amount to its respective mechanism cylinder 12 so that the mechanism cylinders 12, 14 move the same distance and speed. The remaining volume of fluid $V_x$ in the second chamber 42 is moved from the large diameter barrel 62 into the small diameter barrel 60 through the junction 30. Thus, in the fully extended position shown in FIG. 4*a*, the space occupied by the volume of fluid $V_o$ when the cylinder 10 was in the fully retracted position is now occupied by the volume of fluid $V_x$ that moved from the large diameter barrel 62 into the small diameter barrel 60 (represented by the X shading) and the volume $V_R$ occupied by the rod 20.

Figure 8:
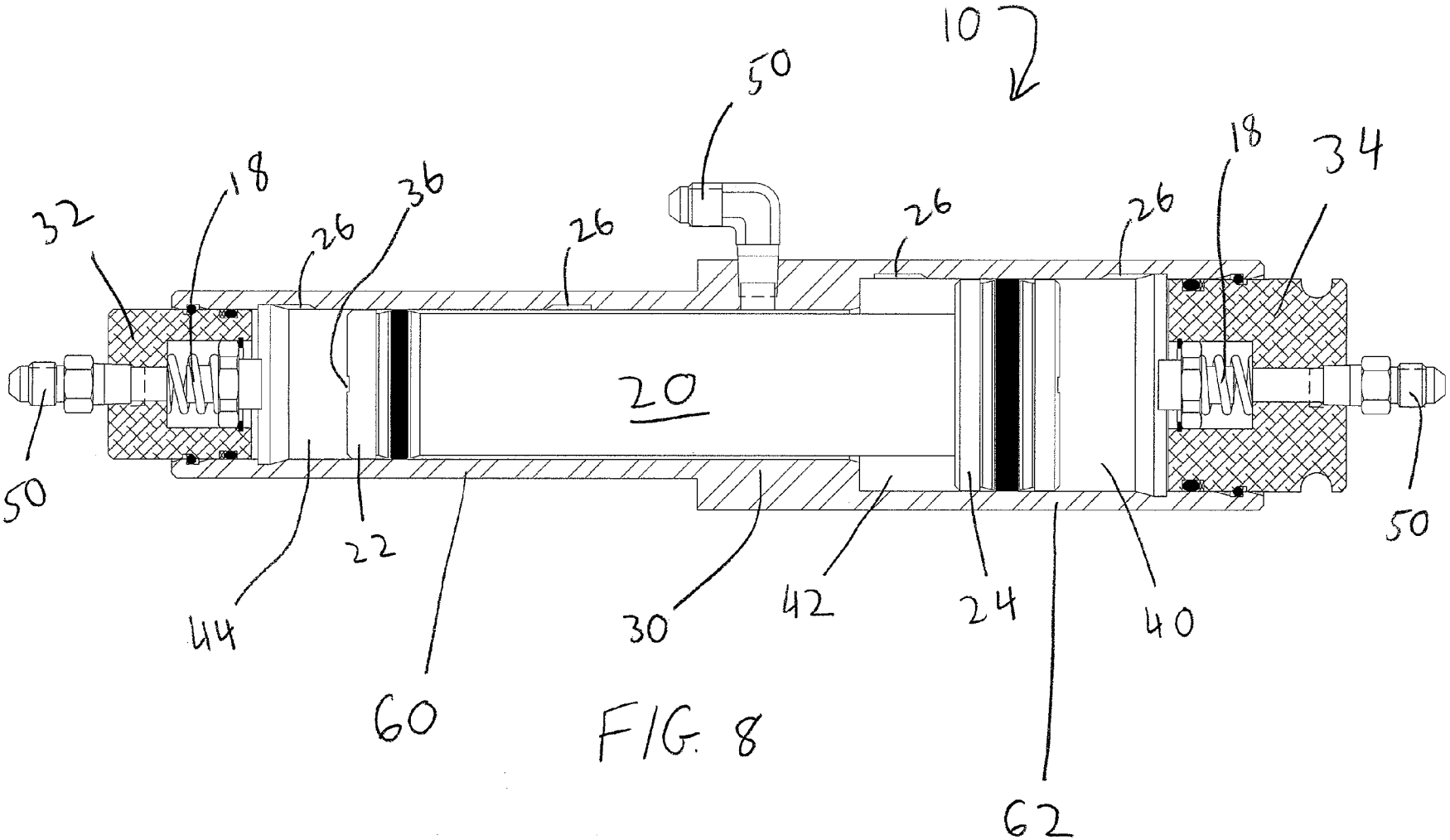
FIG. 8 is a sectional view similar to FIG. 3 but showing an embodiment wherein the small diameter barrel is the same diameter as the rod.
Figure 9:
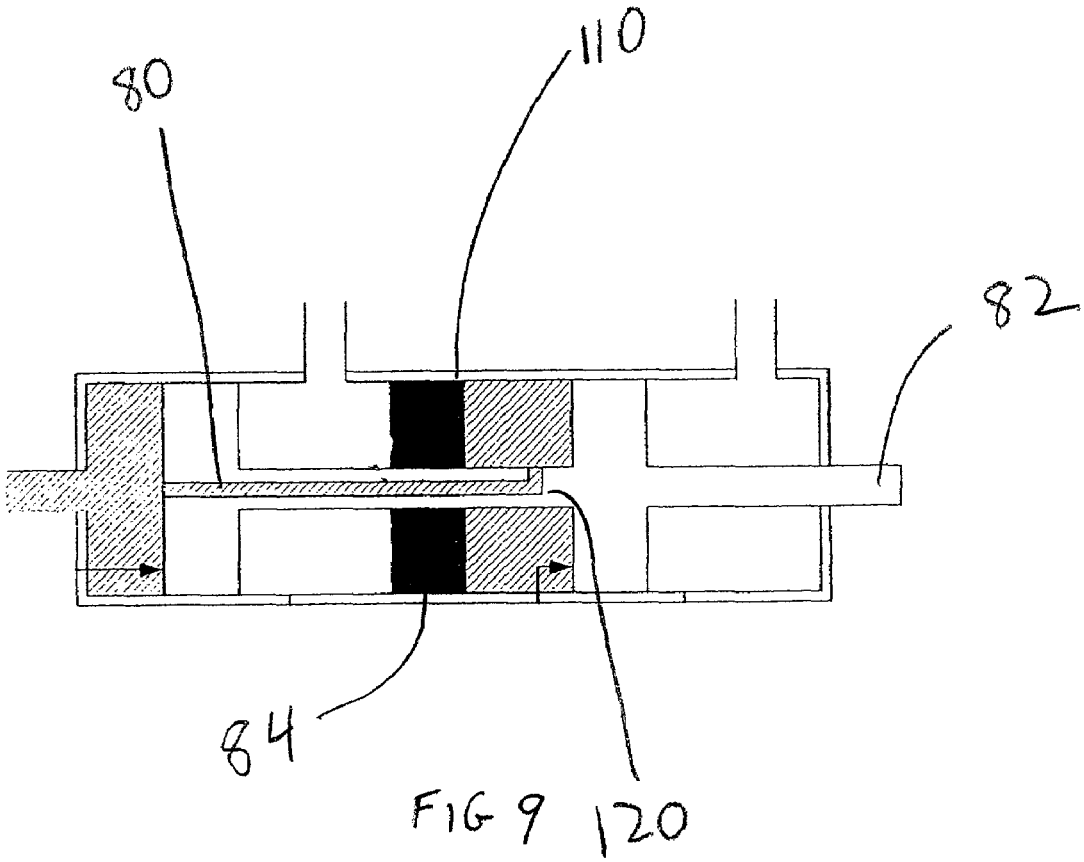
FIG 9 (Prior Art)
FIG. 9 is a sectional view of a prior art synchronizing cylinder.

FIG. 8 shows an alternate embodiment wherein the diameter of the rod 20 approximates the diameter of the small diameter barrel 60. This embodiment is similar to the above described embodiment wherein the volume of the large diameter barrel 62 is twice the volume of the small diameter barrel 60. In this embodiment, the large diameter barrel 62 comprises a fluid volume $V_\sim$ that is equal to the volume $V_o$ of the third chamber 44 (same as above). However, in this embodiment, the volume of the rod $V_{R1}$ in the second chamber 42 is equal to $V_\sim$ and $V_o$ when the cylinder 10 is in the retracted position ($V_{R1}=V_\sim=V_o$). In other words, the volume of the second chamber 42 when the cylinder 10 is in the retracted position is $V_{R1}+V_{\sim}$, which equals $2V_o$. As the synchronizing cylinder 10 is extended, the fluid volume $V_{\sim}$ from the second chamber 42 is communicated to the mechanism cylinder 12 and the portion of the rod 20 having volume $V_{R1}$ in the second chamber 42 is transferred into the small diameter barrel 60.

Figure 7:
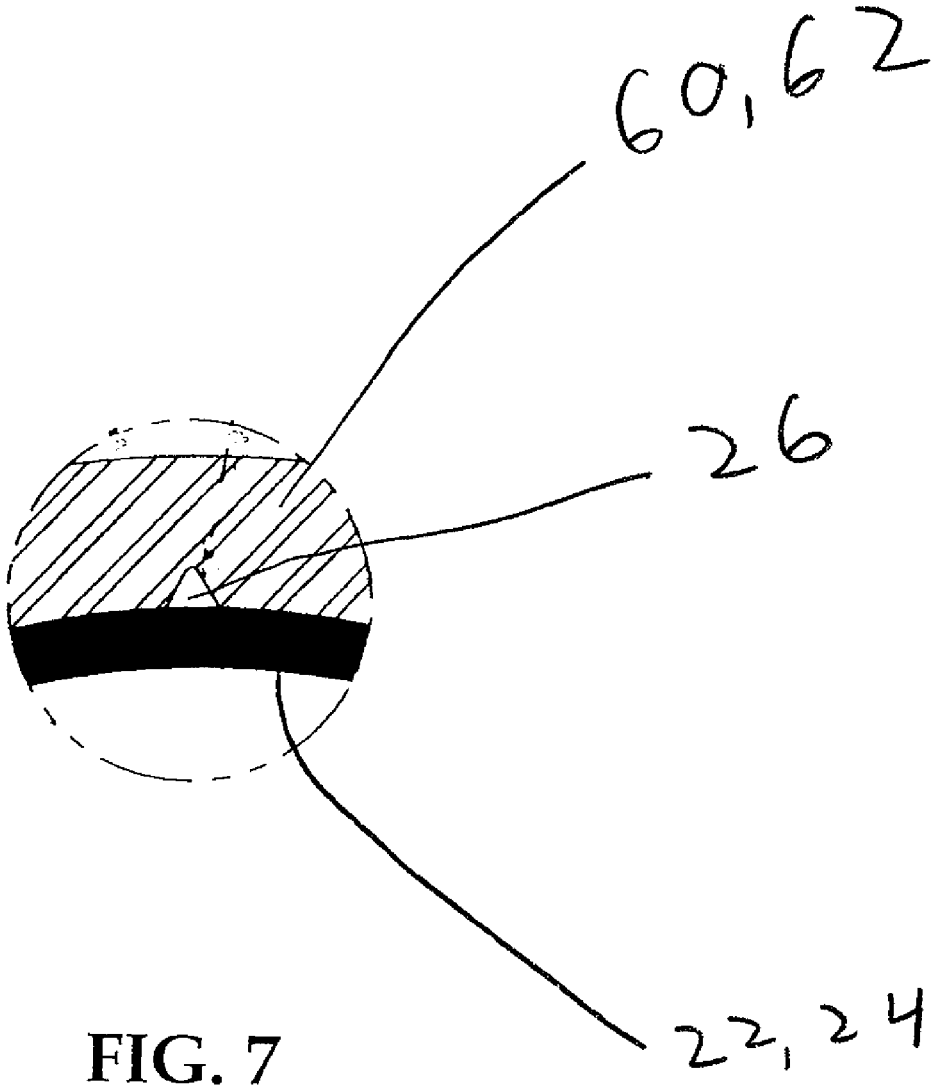
FIG. 7 is a sectional view taken on the line B-B of FIG. 4 and showing the notch synchronizing mechanism.

In some embodiments, the synchronizing cylinder 10 uses a synchronizing mechanism to synchronize the synchronizing cylinder 10 and mechanism cylinders 12, 14 at the end of their stroke. FIGS. 2-5 and 7-8 show an embodiment wherein the synchronizing mechanisms are notches 26. As seen in FIGS. 2-5, the notches 26 are a part of the barrels 60, 62 where fluid can flow around the pistons 22, 24 when the pistons are proximate to the notches 26. FIG. 7 shows a section view of a piston 22, 24 against the inside diameter of a barrel 60, 62 with the notch 26.

FIG. 3 shows the rod 20 between its extended and retracted position wherein the pistons 22, 24 have not reached the notches 26, so all three chambers 40, 42, 44 are sealed from each other by the pistons 22, 24. FIG. 5 shows the synchronizing cylinder 10 in its retracted position wherein the pistons 22, 24 are proximate the notches 26 thereby allowing fluid to flow around the pistons 22, 24 so that all three chambers 40, 42, 44 are open to one another allowing the synchronizing cylinder 10 to function like a junction or tee. The mechanism cylinders 12, 14 are extended or nearly extended at this time and can move independently of one another due to the chambers 40, 42, 44 being open to each other. FIG. 4 shows the synchronizing cylinder 10 in its extended position wherein the pistons 22, 24 are proximate the notches 26 to allow all three chambers 40, 42, 44 to be open to one another allowing the synchronizing cylinder 10 to function like a junction or tee. All three chambers 40, 42, 44 are open to one another via the notches 26 in the barrel. The mechanism cylinders 12, 14 are retracted or nearly retracted at this time and can move independently of one another.

In the embodiments wherein the synchronizing mechanisms are notches 26, the synchronizing cylinder 10 preferably comprises a spring mechanism 18 in each end cap 32, 34. The spring mechanisms 18 can be seen in FIGS. 2-5. The spring mechanisms 18 comprise a spring or similar mechanism for pushing the piston 22, 24/rod 20 assembly off of the notches 26 away from the end cap 32, 34. The spring mechanisms 18 are necessary because when the piston 22, 24 is proximate to the notches 26 and all chambers 40, 42, 44 are open to each other, the piston 22, 24/rod 20 assembly will not move unless there is an external force moving it, such as the force of the spring mechanism 18.

Figure 6:
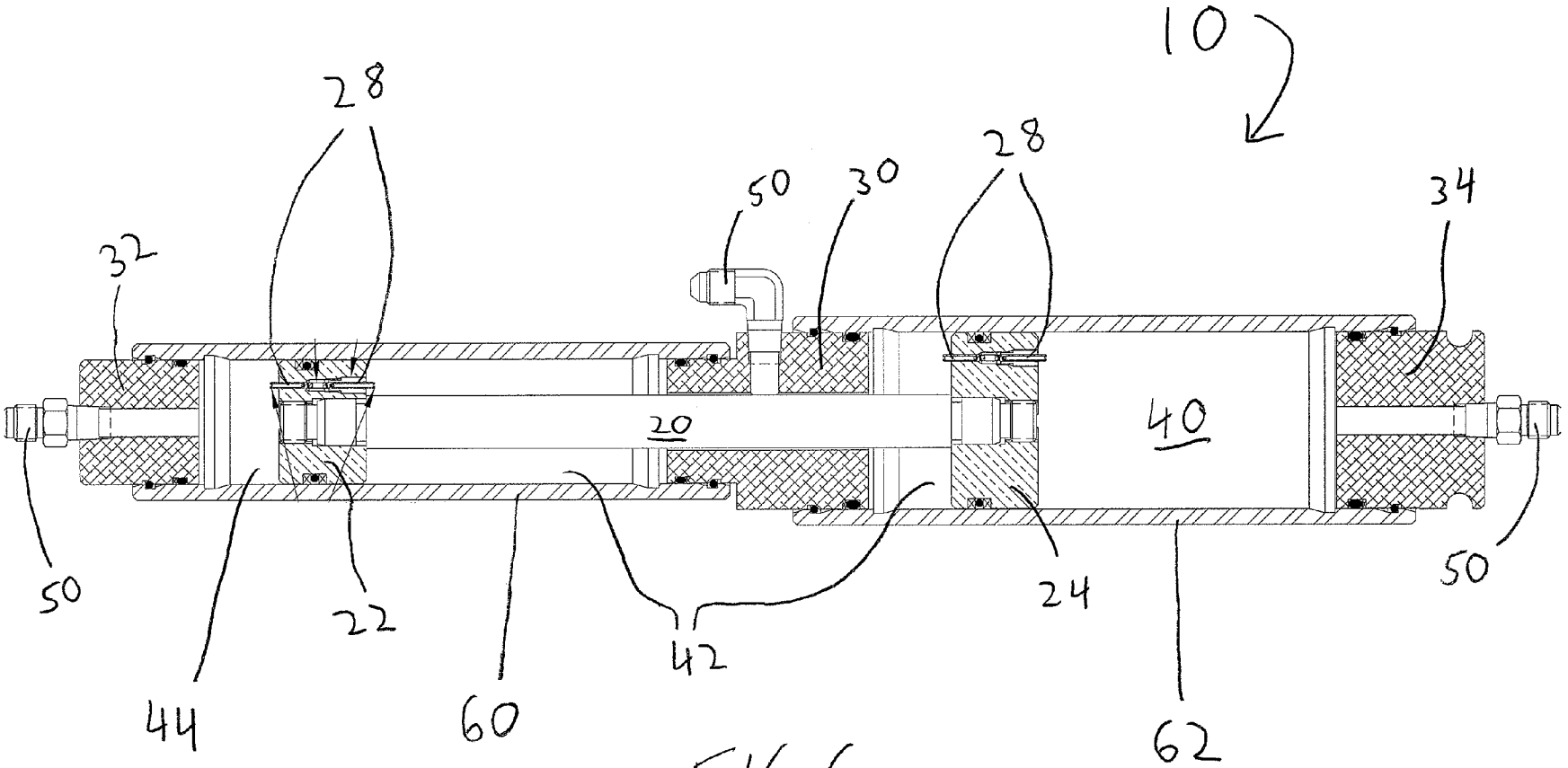
FIG. 6 is a sectional view similar to FIG. 5*a* but showing an embodiment wherein the synchronizing mechanisms are poppets.

In an alternate embodiment shown in FIG. 6, the synchronizing mechanisms are poppets 28. The use of synchronizing valves or poppets 28 with synchronizing cylinders 20 is generally known. As seen in the figures, the poppets 28 are combined with the pistons 22, 24 so that as the pistons 22, 24 get to the end of their stroke, the poppets 28 contact a non-moving portion of the synchronizing cylinder 10 such as the junction 30. When the poppets 28 are actuated, they open and allow fluid communication between the chambers 40, 42, 44. As with the notchces 26 discussed above, this helps resynchronize the mechanism cylinders 12, 14 if one cylinder 12, 14 needs to stroke more than the others.

Some embodiments of the synchronizing cylinder 10 comprise a relief mechanism 36 as shown in FIG. 4. The relief mechanisms 36 are located on the ends of the pistons 22, 24. If a piston 22, 24 comes in contact with the inside face of its respective end cap 32, 34, it will seal against the end cap 32, 34 and not permit the flow of fluid. The relief mechanisms 36 will provide flow if the piston 22, 24 and end cap 32, 34 come in contact with each other.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. A fluid synchronizing cylinder in communication with at least two mechanism cylinders and a manifold for synchronizing the fluid flow between the mechanism cylinders, said synchronizing cylinder comprising:

a large diameter barrel having a large piston therein;

a small diameter barrel having a small piston therein;

a rod combining the pistons so that the movement of one piston causes the other piston to move the same distance at the same speed; and a junction combining the large diameter barrel with the small diameter barrel and the junction is not fluidly sealed so that fluid can be communicated between the barrels, wherein volume of the large diameter barrel is twice the volume of the small diameter barrel.

2. A fluid synchronizing cylinder in communication with at least two mechanism cylinders and a manifold for synchronizing the fluid flow between the mechanism cylinders, said synchronizing cylinder comprising:

a large diameter barrel having a large piston therein;

a small diameter barrel having a small piston therein, wherein volume of the large diameter barrel is twice the volume of the small diameter barrel;

a rod combining the pistons so that the movement of one piston causes the other piston to move the same distance at the same speed;

synchronizing mechanisms for synchronizing the synchronizing cylinder and mechanism cylinders at the end of their stroke an end cap in each of the barrels; and a spring mechanism in each end cap for pushing the piston off of the synchronizing mechanism away from the end cap.

3. A fluid synchronizing cylinder in communication with at least two mechanism cylinders and a manifold for synchronizing the fluid flow between the two mechanism cylinders, said synchronizing cylinder comprising:

a large diameter barrel and a small diameter barrel separated by a junction;

a first piston in the large diameter barrel;

a second piston in the small diameter barrel, said second piston combined with the first piston by a rod so that movement of one piston causes the other pistons to move the same distance at the same speed;

wherein the pistons and rod have a retracted position and an extended position;

a first end cap at a first end of the synchronizing cylinder and a second end cap at a second end of the synchronizing cylinder;

a first chamber defined as the area between the first piston and the first end cap;

a second chamber defined as the area between the first piston and the second piston minus the area of the junction;

a third chamber defined as the area between the second piston and the second end cap;

wherein the volume of the second chamber is twice the volume of the third chamber when the pistons and rod are in their retracted position.

4. The synchronizing the cylinder of claim 3 further comprising ports through which fluid is communicated to and from the mechanism cylinders and the manifold.

5. The synchronizing cylinder of claim 3 wherein the barrels are round.

6. The synchronizing cylinder of claim 3 further comprising synchronizing mechanisms for synchronizing the synchronizing cylinder and mechanism cylinders at the end of their stroke.

7. The synchronizing cylinder of claim 6 wherein the synchronizing mechanisms are notches.

8. The synchronizing cylinder of claim 7 further comprising a spring mechanism in each end cap for pushing the piston off of the notches away from the end cap.

9. The synchronizing cylinder of claim 6 wherein the synchronizing mechanisms are poppets.

* * * * *